US006484350B2

(12) United States Patent
Yung

(10) Patent No.: US 6,484,350 B2
(45) **Date of Patent: *Nov. 26, 2002**

(54) BAGLESS CANISTER VACUUM CLEANER

(75) Inventor: Billy Yung, Hong Kong (HK)

(73) Assignee: Shell Electric MFG. (Holdings) Co. Ltd., Chai Wan (HK)

( * ) Notice: Subject to any disclaimer, the term of this patent is extended or adjusted under 35 U.S.C. 154(b) by 0 days.

This patent is subject to a terminal disclaimer.

(21) Appl. No.: 09/991,146

(22) Filed: Nov. 13, 2001

(65) Prior Publication Data

US 2002/0069476 A1 Jun. 13, 2002

Related U.S. Application Data

(63) Continuation of application No. 09/457,613, filed on Dec. 8, 1999, now Pat. No. 6,269,518.

(51) Int. Cl.[7] ..... A47L 5/36

(52) U.S. Cl. ..... 15/327.1; 15/352; 15/353; 55/337

(58) Field of Search ..... 15/327.1, 327.7, 15/352, 353; 55/337

(56) References Cited

U.S. PATENT DOCUMENTS

| | | | |
|---|---|---|---|
| 1,476,004 | A | 12/1923 | Orr |
| 1,508,315 | A | 9/1924 | Brockway |
| 1,631,549 | A | 6/1927 | Pease |
| 1,656,031 | A | 1/1928 | Aalborg |
| 1,742,671 | A | 1/1930 | Squires |
| 1,829,582 | A | 10/1931 | Carson |
| 1,965,614 | A | 7/1934 | Sellers |
| 2,017,893 | A | 10/1935 | Boettler |
| 2,064,587 | A | 12/1936 | Carlstedt |
| 2,254,666 | A | 9/1941 | Smellie |
| 2,272,814 | A | 2/1942 | Olson |
| 2,316,836 | A | 4/1943 | Breuer |
| 2,330,621 | A | 9/1943 | Radke |
| 2,337,936 | A | 12/1943 | Sellers |
| 2,375,331 | A | 5/1945 | Taylor |
| 2,394,923 | A | 2/1946 | Little |
| 2,409,230 | A | 10/1946 | Taylor |
| 2,416,417 | A | 2/1947 | Taylor |
| 2,416,418 | A | 2/1947 | Taylor |
| 2,416,419 | A | 2/1947 | Pickford |
| 2,475,808 | A | 7/1949 | Storm, Jr. |
| 2,482,166 | A | 9/1949 | Gage |

(List continued on next page.)

FOREIGN PATENT DOCUMENTS

| | | |
|---|---|---|
| CA | 1182613 | 2/1985 |
| CA | 2061469 | 2/1992 |
| CA | 2221500 | 11/1995 |

(List continued on next page.)

*Primary Examiner*—Chris K. Moore
(74) *Attorney, Agent, or Firm*—Sheldon & Mak; Denton L. Anderson

(57) ABSTRACT

A bagless canister vacuum cleaner having a chasse, an air blower and a dust extraction and collection unit is provided. The dust extraction and collection unit has an easily removable inlet chamber and an easily removable outlet chamber. The inlet chamber is substantially cylindrical, and the outlet chamber is disposed concentrically within the upper portion of the inlet chamber. Duct work within the chasse conducts air from the air inlet and into the inlet chamber in tangential fashion, such that air swirls about the inside walls of the inlet chamber. Air within the inlet chamber is then allowed to escape from the inlet chamber into the outlet chamber via a plurality of small holes disposed in the side walls of the outlet chamber. Air within the outlet chamber is exhausted to the blower via a top wall opening in the outlet chamber. The outlet chamber contains a vertical, cylindrical filter disposed concentrically within the outlet chamber and a second, planar filter disposed across the top wall opening of the outlet chamber.

11 Claims, 4 Drawing Sheets

U.S. PATENT DOCUMENTS 2,484,491 A 10/1949 Daugherty
2,507,897 A 5/1950 Gavagnin
2,516,707 A 7/1950 Lewyt et al.
2,524,117 A 10/1950 Storm, Jr.
2,564,339 A 8/1951 Nerheim
2,592,710 A 4/1952 Kirby
2,618,007 A 11/1952 Fuller
2,648,396 A 8/1953 Kirby
2,916,104 A 12/1959 Hultberg et al.
2,921,646 A 1/1960 Poole
3,040,366 A 6/1962 Vance
3,078,650 A * 2/1963 Anderson et al. ..... 55/337
3,148,400 A 9/1964 Wörwag
3,177,635 A 4/1965 Cawl et al.
3,320,727 A 5/1967 Farley et al.
3,482,276 A 12/1969 Fillery
3,618,158 A 11/1971 Wörwag
3,621,640 A 11/1971 Ohno et al.
3,758,914 A 9/1973 Nupp et al.
3,797,064 A 3/1974 MacFarland
3,820,310 A 6/1974 Fromknecht et al.
3,906,585 A 9/1975 Mattsson
3,910,781 A 10/1975 Bryant, Jr.
3,914,820 A 10/1975 Hankel
4,072,483 A 2/1978 Doyle, Jr.
4,108,778 A 8/1978 Lambert et al.
4,118,208 A 10/1978 Klinedinst
4,172,710 A 10/1979 Van Der Molen
4,198,726 A 4/1980 Powell, Jr.
4,268,288 A 5/1981 Coombs
4,276,070 A 6/1981 Hug
4,284,422 A 8/1981 Ferland
4,355,434 A 10/1982 Gongwer
4,373,228 A 2/1983 Dyson
4,426,211 A 1/1984 Ataka et al.
4,443,235 A 4/1984 Bernholt et al.
4,443,910 A 4/1984 Fitzwater
4,457,043 A 7/1984 Oeberg et al.
4,486,206 A 12/1984 Miyakawa et al.
4,523,936 A 6/1985 Disanza, Jr.
4,547,206 A * 10/1985 Sovis et al. ..... 15/353
4,571,772 A 2/1986 Dyson
4,573,236 A 3/1986 Dyson
4,593,429 A 6/1986 Dyson
4,617,034 A 10/1986 Ibezaki et al.
4,643,748 A 2/1987 Dyson
4,718,924 A 1/1988 Demarco
4,745,654 A 5/1988 Yamamoto et al.
4,769,052 A 9/1988 Kowalski
4,826,515 A 5/1989 Dyson
4,853,008 A 8/1989 Dyson
4,853,011 A 8/1989 Dyson
D305,269 S 12/1989 Dyson
4,944,780 A 7/1990 Usmani
5,018,240 A 5/1991 Holman
5,020,186 A 6/1991 Lessig, III et al.
5,062,870 A 11/1991 Dyson
5,078,761 A 1/1992 Dyson
5,090,975 A 2/1992 Requejo et al.
5,090,976 A 2/1992 Dyson
5,101,532 A 4/1992 Dyson et al.
5,115,538 A 5/1992 Cochran et al.
5,135,552 A 8/1992 Weistra
5,145,499 A 9/1992 Dyson
5,160,356 A 11/1992 Dyson
5,230,722 A 7/1993 Yonkers
5,248,323 A 9/1993 Stevenson
5,248,858 A 9/1993 Lin
5,267,371 A 12/1993 Soler et al.
5,271,751 A 12/1993 Lägler
D343,707 S 1/1994 Dyson
5,287,591 A 2/1994 Rench et al.
5,307,538 A 5/1994 Rench et al.
5,358,290 A 10/1994 Fleet et al.
5,427,597 A 6/1995 Osendorf
5,464,460 A 11/1995 Bosses
D365,669 S 12/1995 Piccaluga et al.
5,558,697 A 9/1996 Dyson et al.
D375,820 S 11/1996 Piccaluga et al.
5,593,479 A 1/1997 Frey et al.
5,603,740 A 2/1997 Roy
5,603,741 A 2/1997 Frey
D379,694 S 6/1997 Bradd
5,664,285 A 9/1997 Melito et al.
D385,072 S 10/1997 Bradd
5,685,894 A 11/1997 Bowerman et al.
5,704,956 A 1/1998 Loveless et al.
5,779,744 A 7/1998 Mueller et al.
5,779,745 A 7/1998 Kilström
5,829,090 A 11/1998 Melito et al.
5,845,782 A 12/1998 Depew
5,846,273 A 12/1998 Dyson
5,853,440 A 12/1998 Dyson
5,858,038 A 1/1999 Dyson et al.
D407,874 S 4/1999 Burchard et al.
5,893,936 A 4/1999 Dyson
5,893,938 A 4/1999 Dyson
5,937,477 A * 8/1999 Dyson ..... 15/327.2
6,003,196 A 12/1999 Wright et al.
6,026,540 A 2/2000 Wright et al.

FOREIGN PATENT DOCUMENTS

CA 2210177 1/1996
CA 2266115 3/1999
CA 2221499 11/1999
EP 0042723 B1 6/1981
EP 0126667 B1 6/1982
EP 0127667 B1 11/1987
EP 0928594 A1 3/1998
GB WO9934722 7/1999

* cited by examiner

BAGLESS CANISTER VACUUM CLEANER

RELATED APPLICATION

This application is a continuation application to the U.S. patent application Ser. No. 09/457,613, filed on Dec. 8, 1999, which is issued as U.S. Pat. No. 6,269,518 B1 on Aug. 7, 2001.

FIELD OF THE INVENTION

This invention relates generally to canister vacuum cleaners and, more particularly, to bagless canister vacuum cleaners.

BACKGROUND OF THE INVENTION

Bagless vacuum cleaners have become very popular over the last several years. This popularity is due in large part to the ease with which dust and dirt can be removed from such vacuum cleaners. These vacuum cleaners include canister vacuum cleaners. A canister vacuum cleaner is a type of vacuum cleaner that has a lower chassis than a stand-up type of vacuum cleaner. A typical canister vacuum cleaner has a chassis that is about two (2) feet from the ground. In old style cloth bag-containing canister vacuum cleaners, dust and dirt removal is a difficult and awkward process, frequently requiring the user to extend his or her hand into the cloth bag to physically disengage dust clumps. Canister vacuum cleaners using disposable liner bags minimize the problems associated with cloth bags, but the use of such canister vacuum cleaners requires the continuous replenishment and installation of disposable liner bags. (Also, owners of older model disposable liner bag-containing canister vacuum cleaners often find it difficult to locate a source of properly sized replacement liner bags.) Contrary to these problems associated with bag-containing canister vacuum cleaners, dirt and dust vacuumed up using bagless canister vacuum cleaners is conveniently deposited into an easily removable permanent container, from which dust and dirt can be disposed of without the effort associated with cloth bag-containing canister vacuum cleaners and without having to continually purchase and reinstall disposable liner bags.

Bagless canister vacuum cleaners of the prior art, however, have not been fully satisfactory. Most bagless canister vacuum cleaners have not demonstrated the ability to fully disengage dust and dirt from the vacuum air stream. Those prior art bagless canister vacuum cleaners which have been reasonably successful in disengaging dust and dirt from the vacuum air stream have required a high degree of mechanical complexity. Such mechanical complexity has tended to make those prior art bagless canister vacuum cleaners unduly expensive to manufacture and maintain.

Accordingly, there is a need for a bagless canister vacuum cleaner which avoids these problems with the prior art.

SUMMARY

The invention satisfies this need. The invention is a bagless canister vacuum cleaner that is (a) a chassis having a housing unit, the housing unit having an air inlet and roller means for moving the canister vacuum cleaner across a flat surface, (b) an air blower disposed within the chassis, (c) a dust reaction and collection unit disposed within the housing unit and (d) duct work for serially connecting in fluid communication the air inlet in the housing unit, the inlet chamber, the outlet chamber and the air blower. The dust extraction and collection unit comprises an enclosed inlet chamber and an enclosed outlet chamber. The inlet chamber is substantially cylindrical with a typical internal diameter between about 130 mm and about 200 mm. The inlet chamber comprises a bottom wall, generally vertical sidewalls, an upper section, a lower section and an air inlet opening. The sidewalls have an interior height, typically between about 200 mm and about 250 mm, and the upper section of the inlet chamber has an air inlet opening through the sidewalls. The enclosed outlet chamber is disposed concentrically within the upper section of the inlet chamber. The outlet chamber has a bottom wall, a top wall and generally vertical sidewalls. The top wall has a top wall opening and the sidewalls have an interior height, typically between about 50 mm and about 100 mm. The sidewalls also have a large plurality of inlet apertures, each inlet aperture, typically defining an area between about 3 $mm^2$ and about 30 $mm^2$. The inlet apertures are disposed in a band around the sidewalls of the outlet chamber, the band typically has a width between about 20 mm and about 50 mm and a median line disposed between about 30 mm and about 50 mm above the bottom wall. The outlet chamber also has an upper section, a lower section and a circular exterior perimeter edge member disposed around the sidewalls in the lower section of the outlet chamber. The exterior edge member has a diameter which is typically between about 10 mm and about 60 mm less than the internal diameter of the inlet chamber.

In one embodiment, the outlet chamber contains at least one filter for filtering out residual dust within the air prior to the air being exhausted from the outlet chamber. In preferred embodiments, the outlet chamber contains at least two separate filters. In more preferred embodiments, an additional filter, most preferably a HEPA filter, is disposed downstream of the blower to remove virtually all remaining traces of entrained dust particles.

The invention has been found to provide a canister vacuum cleaner with all the conveniences of prior art canister vacuum cleaners, but with increased dust removal efficiency and without excessive mechanical complexity and resulting expense of manufacture.

DRAWINGS

These features, aspects and advantages of the present invention will become better understood with regard to the following description, appended claims and accompanying figures where:

Figure 4:
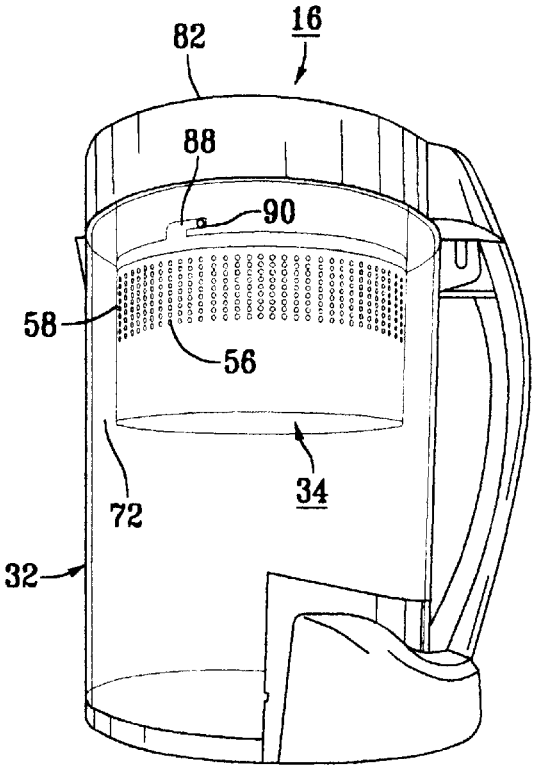
Figure 5:
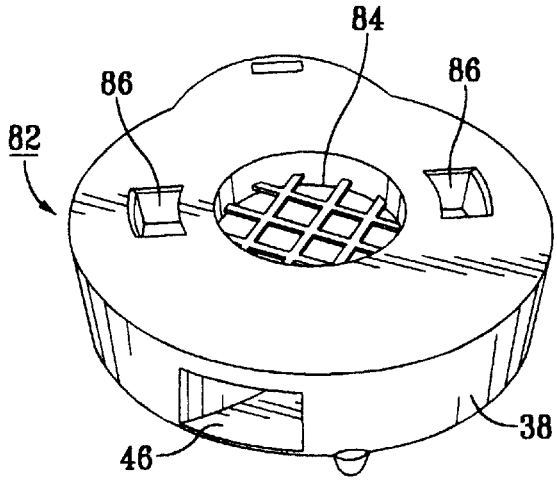
Figure 6:
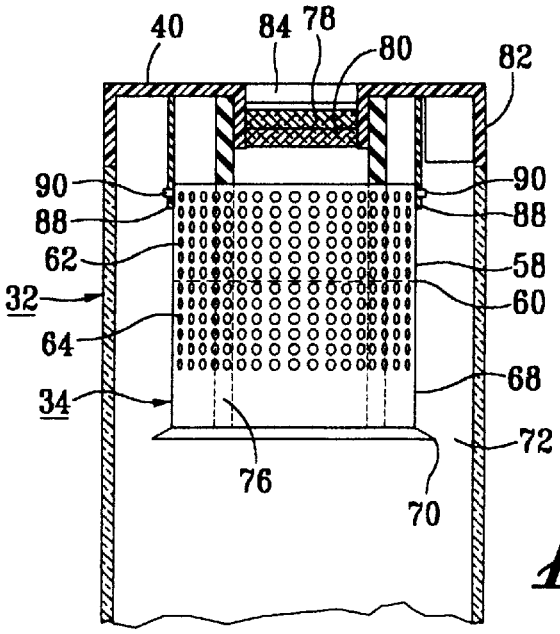
Figure 7:
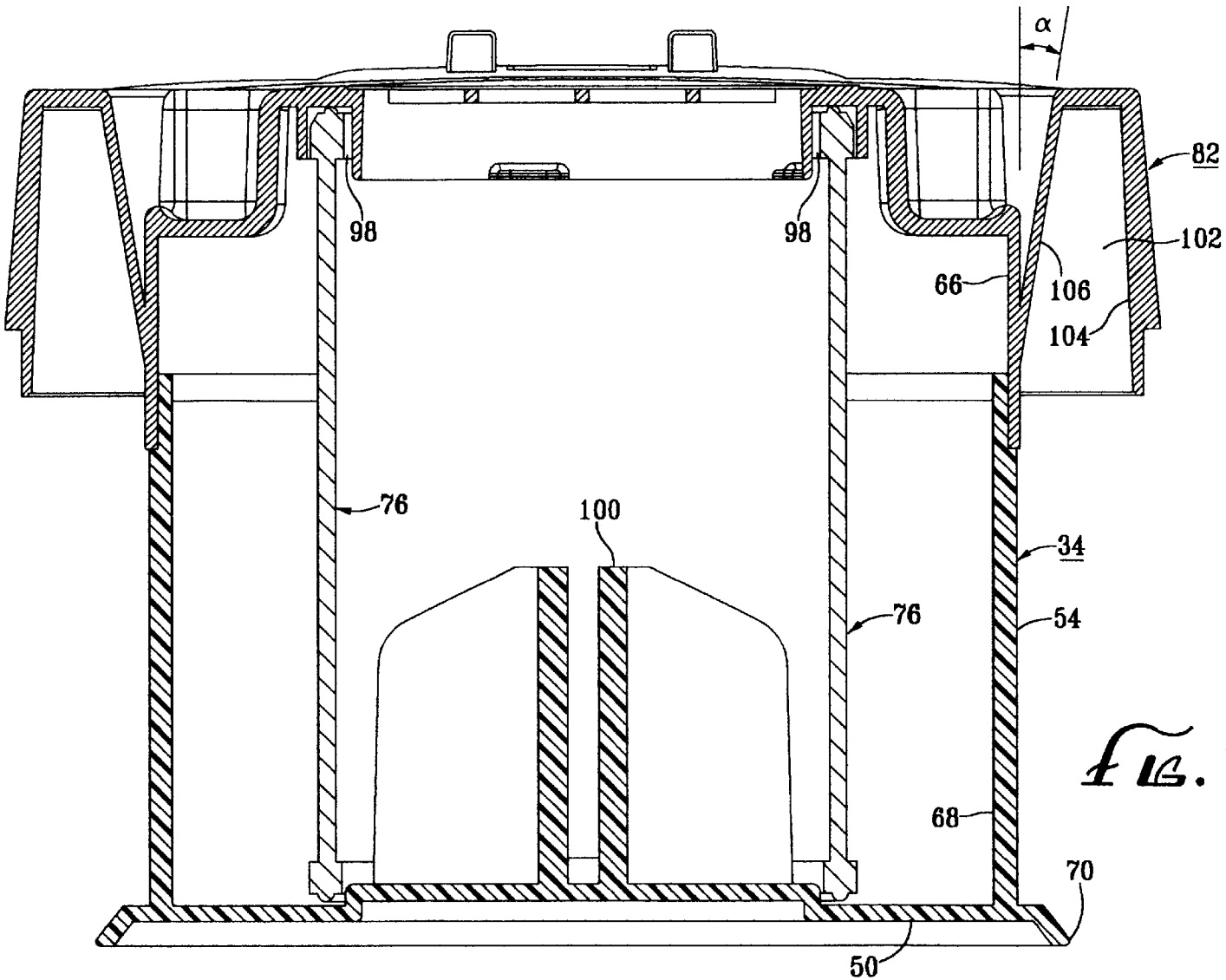

FIG. 4; is a perspective view of a dust extraction and collection unit useable in the invention;

FIG. 5; is a perspective view of a cover useable to enclose the dust extraction and collection unit illustrated in FIG. 4;

FIG. 6; is a detailed cross-sectional side view of a dust extraction and collection unit illustrated in FIG. 4; and FIG. 7 is a detailed cross-sectional side view of another dust extraction and collection unit useable in the invention.

DETAILED DESCRIPTION

The following discussion describes in detail one embodiment of the invention and several variations of that embodiment. This discussion should not be construed, however, as limiting the invention to those particular embodiments.

Practitioners skilled in the art will recognize numerous other embodiments as well.

Figure 3:
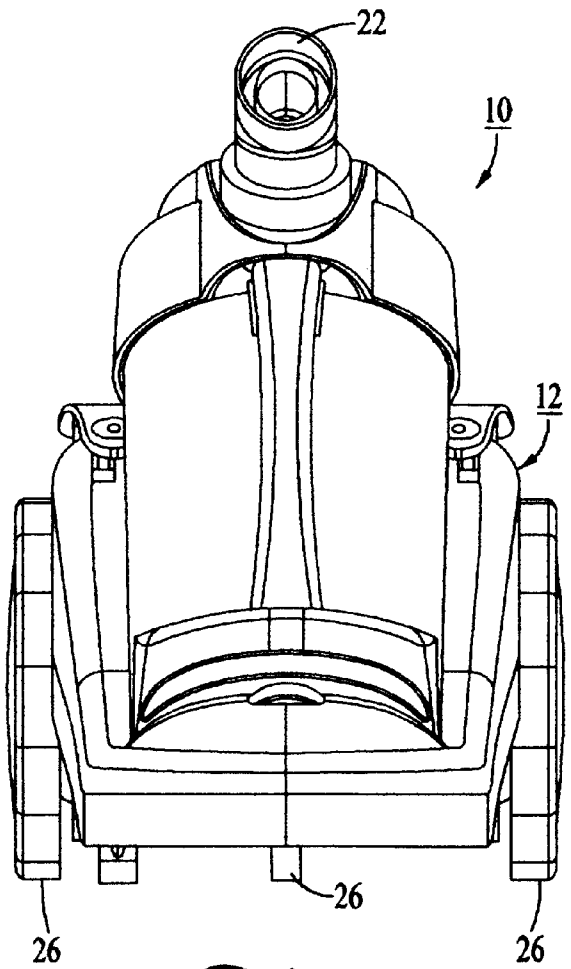
FIG. 3 is a perspective rear view of the canister vacuum cleaner illustrated in FIG. 1.
Figure 1:
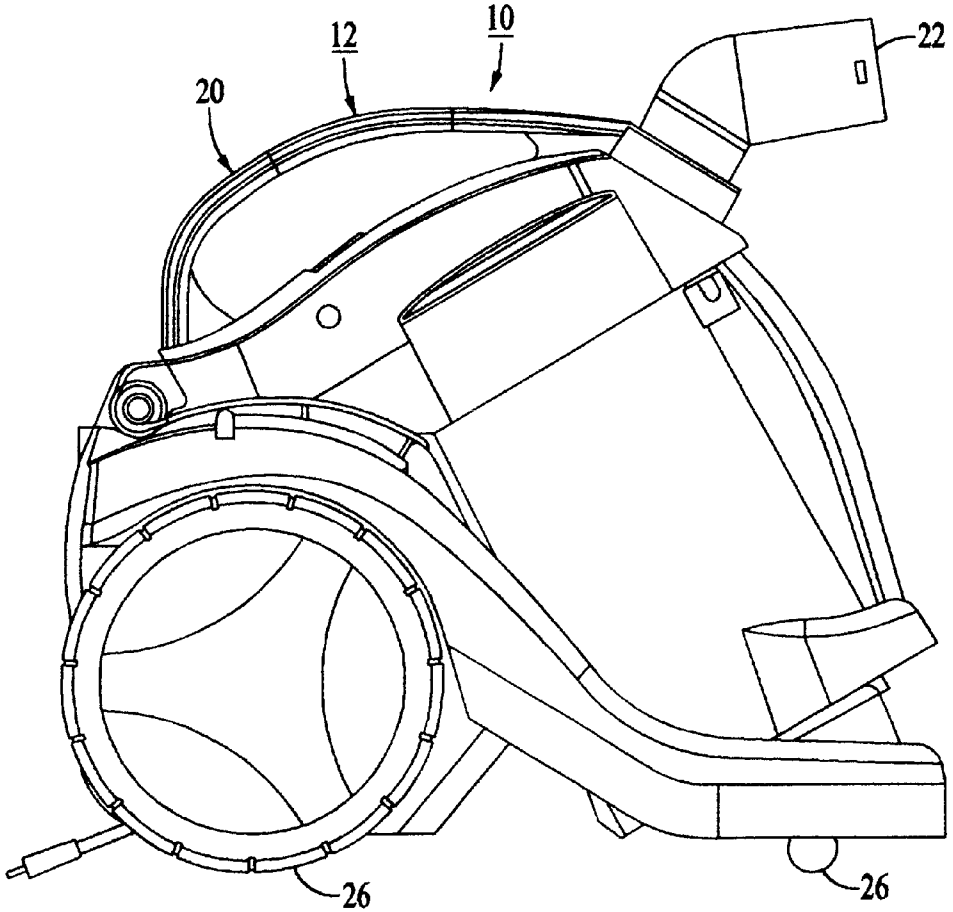
FIG. 1 is a perspective front view of a canister vacuum cleaner having features of the invention.
Figure 2:
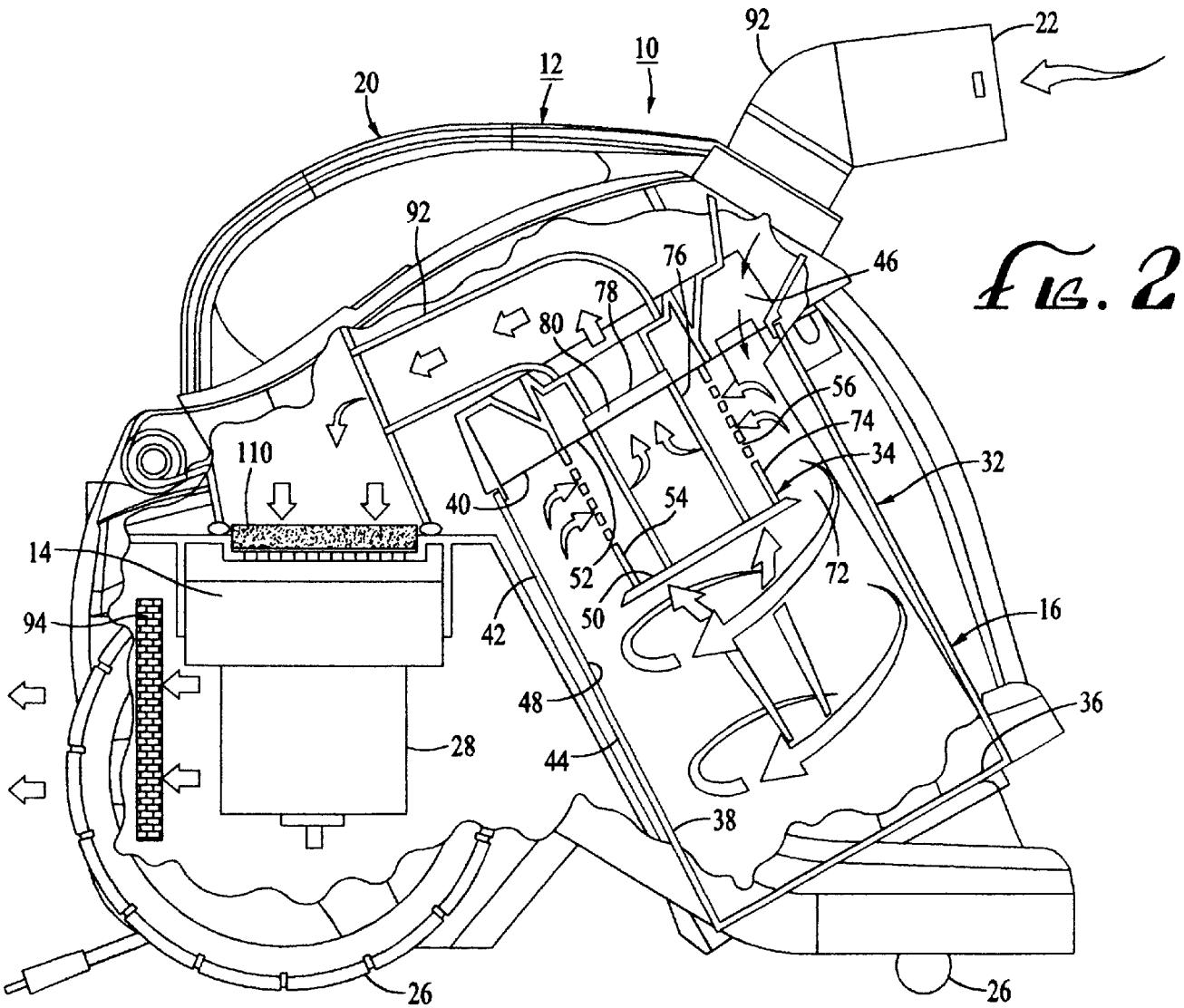
FIG. 2 is a diagrammatic cut away front view of the canister vacuum cleaner illustrated in FIG. 1.

As illustrated in FIGS. 1, 2 and 3, the invention is a canister vacuum cleaner 10 having a chassis 12, an air blower 14 and a dust extraction and collection unit 16.

The chassis 12 comprises a housing unit 20. The housing unit 20 has an air inlet 22 wherein dust and dirt is sucked up into the chassis 12. In a typical embodiment, the air inlet 22 is connected to an air hose and a floor unit to collect dirt.

The housing unit 20 further comprises roller means for moving the canister vacuum cleaner 10 across a flat surface. In the embodiment illustrated in the drawings, such roller means includes a plurality of wheels 26 disposed, for example, at the front and the rear bottom of the housing base unit 20.

The air blower 14 is disposed within the chassis 12. The air blower 14 is typically an electrically driven air blower having a capacity between about 50 $m^3$/hour and about 200 $m^3$/hour. A typical electrical motor 28 for driving the blower operates on ordinary house current and has a power capacity between about 800 watts and about 2000 watts.

The dust extraction and collection unit 16 is disposed within the housing unit 20. The dust extraction and collection unit 16 comprises an enclosed inlet chamber 32 and an enclosed outlet chamber 34.

The inlet chamber 32 is substantially cylindrical in shape with an internal diameter between about 130 mm and about 200 mm, preferably between about 150 mm and about 180 mm. The inlet chamber 32 comprises a bottom wall 36, generally vertical sidewalls 38 and a top wall 40. The sidewalls 38 typically have an interior height between about 200 mm and about 250 mm, most typically between about 220 mm and about 230 mm.

The inlet chamber 32 also has an upper section 42 and a lower section 44. The sidewalls in the upper section 42 of the inlet chamber 32 define an inlet opening 46 for allowing the ingress of dusty air from the air inlet 22. The inlet opening 46 of the inlet chamber 32 is configured to provide the ingress of dusty air into the inlet chamber 32 in tangential fashion wherein the ingressing dusty air is caused to downwardly spiral around the internal surface 48 of the inlet chamber sidewalls 38. In this regard, the lateral edges of the inlet opening 46 are beveled, the exterior wall at the upstream lateral edge of the inlet opening 46 being beveled and the interior surface of the downstream lateral edge of the inlet opening 46 being beveled.

The inlet chamber 32 is preferably reversibly installable and deinstallable within the chassis 12. In the embodiment illustrated in the drawings, the inlet chamber 32 is reversibly installable and deinstallable within the chassis 12 via a press-fit connection between the inlet chamber walls and the walls of the chassis 12. In another embodiment (not shown), the inlet chamber 32 is reversibly installable and deinstallable within the chassis 12 using a snap-on connection.

The outlet chamber 34 is disposed concentrically within the upper section 42 of the inlet chamber 32. The outlet chamber 34 has a bottom wall 50, a top wall 52 and generally vertical sidewalls 54. The sidewalls 54 have an interior height between about 50 mm and about 100 mm, preferably between about 80 mm and about 90 mm.

The sidewalls 54 of the outlet chamber 34 are perforated with a plurality of inlet apertures 56, each defining an area between about 3 $mm^2$ and about 30 $mm^2$. In a typical embodiment, the sidewalls 54 define between about 1000 and about 1500 inlet apertures 56, preferably between about 1300 and about 1400 inlet apertures 56. Typically each of the inlet apertures 56 is separated from adjoining inlet apertures 56 by a distance of between about 1.5 mm and about 5 mm. The inlet apertures 56 are preferably disposed in a band 58 around the sidewalls 54 of the outlet chamber 34. Typically, the band 58 has a width between about 20 mm and about, 50 mm, preferably between about 30 mm and about 40 mm. The band 58 defines a median line 60 which divides the uppermost apertures 62 from a substantially equal number of lowermost apertures 64. Typically, the median line 60 is disposed between about 30 mm and about 100 mm above the bottom wall 50 of the outlet chamber 34, preferably between about 50 mm and about 60 mm above the bottom wall 50.

The outlet chamber 34 has an upper section 66 and a lower section 68. Disposed around the sidewalls 54 in the lower section 68 of the outlet chamber 34 is an exterior perimeter edge member 70. The purpose of the exterior edge member 70 is to provide a narrowing of the open annulus 72 between the interior surface 48 of the inlet chamber 32 and the exterior surface 74 of the outlet chamber 34 proximate to the bottom wall 50 of the outlet chamber 34. In a typical embodiment, the exterior edge member 70 has a diameter between about 10 mm and about 60 mm less than the internal diameter of the inlet chamber 32, preferably between about 10 mm and about 20 mm less than the internal diameter of the inlet chamber 32.

In a preferred embodiment, a cylindrical filter 76 is disposed vertically and concentrically within the outlet chamber 34. Typically, such cylindrical filter 76 is made from polypropylene, paper, ceramic or polytetrafluoroethylene having a thickness between about 1.5 mm and about 5 mm.

The top wall 52 of the outlet chamber 34 defines a top wall opening 78. Typically, the top wall opening 78 is disposed in the center of the top wall 52.

In another preferred embodiment, the outlet chamber 34 comprises a planar filter 80 disposed across the top wall 78 opening of the outlet chamber 34. In a typical embodiment, such planar filter 80 is made from sponge, fibrous polyethylene, fibrous polypropylene or paper, and typically has a thickness between about 5 mm and about 15 mm.

As illustrated in FIGS. 4–6, the top wall 40 of the inlet chamber 32 can preferably be provided with a removable cover 82 having a central cover discharge opening 84. In the embodiment illustrated in FIGS. 4–6, the cover 82 further provides the uppermost portion of the sidewalls 38 of the inlet chamber 32. The air opening 46 to the inlet chamber 32 is provided by an air inlet opening 46 within the cover 82. A pair of opposed finger gripping depressions 86 can be disposed in the top surface of the cover 82 to facilitate the cover's removal and reinstallation. In the embodiment illustrated in the drawings, the outlet chamber 34 is attached to the removable cover 82 by a pair of opposed connection hooks 88 disposed over corresponding connection dogs 90.

FIG. 7 illustrates another embodiment of a cover 82 and outlet chamber 34 useable in the invention. In the embodiment illustrated in FIG. 7, the cylindrical filter 76 is disposed within a circular groove 98 defined on the underside of the cover 82. The cylindrical filter 76 is laterally supported at its base by a filter support structure 100 disposed in the lower section 68 of the outlet chamber 34.

The cover defines a plenum 102 into which dusty air is initially directed into the dust extraction and collection unit 16. The plenum 102 has a generally vertical outside wall 104 and a non-vertical inside wall 106. The non-vertical inside wall 106 is slanted outwardly with respect to the vertical by an angle which is between about 0° and about 40°, preferably between about 15° and about 25°. The interior height of the plenum 102 is typically between about 20 mm and about 50 mm, preferably between about 40 mm and about 45 mm. This particular configuration has been found to be particularly advantageous in the invention.

The invention further comprises duct work 92 for serially connecting in fluid communication the air inlet 22 in the housing unit 20, the inlet chamber 32, the outlet chamber 34 and the air blower 14.

It is very important that all such duct work 92 and all connection points within the duct work and between various components in the system and/or the duct work 92 be well-sealed. Even small leaks within the system can markedly decrease efficiency and increase power requirements.

In one embodiment, a planar filter 110 is disposed across the top of the air blower 14. In a typical embodiment, such planar filter 110 is made from sponge, fibrous polyethylene, fibrous polypropylene or paper, and typically has a thickness between about 5 mm and about 15 mm.

In a preferred embodiment, a blower filter 94 is operatively disposed downstream of the air blower 14. Preferably, such blower filter 94 is a HEPA filter.

In operation, the blower motor 28 is first engaged so as to activate the air blower 14. The blower motor 28 creates vacuum action in the inlet chamber 32. Dirty air is collected through an air hose and a floor unit (both are not shown) and passes through the air inlet 22.

As the floor unit is pushed across the dusty horizontal surface, dust from the horizontal surface is drawn upwardly within a dusty air stream and enters the canister vacuum cleaner 10 through the air inlet 22 in the housing unit 20. The duct work 92 directs the incoming dusty air stream into the inlet chamber 32 in tangential fashion, such that the incoming air stream within the inlet chamber 32 spirals downwardly about the internal surface 48 of the sidewalls 38 of the inlet chamber 32. After the dust-laden air stream swirls into the lower section 44 of the inlet chamber 32, the air stream reverses direction, drops in velocity and proceeds upwardly towards the outlet chamber 34. As the air reverses direction and drops in velocity, most of the entrained dust and dirt within the air stream falls out of the air stream falls out of the air stream and collects at the bottom of the inlet chamber 32. The air stream then flows upwardly past the exterior perimeter edge member 70 of the outlet chamber 34 and then into the outlet chamber 34 via the plurality of inlet apertures 56. Within the outlet chamber 34, the air stream passes through the cylindrical filter 76, where additional dust within the air stream is removed. The air stream is then drawn upwardly through the top wall opening 78 of the outlet chamber 34. As the air passes through the top wall opening 78, it is filtered a second time through the planar filter 80 disposed across the top wall opening 78. The air exiting the outlet chamber 34 is then drawn into the blower 14 via the duct work 92. At the outlet of the blower 14, the air is filtered a third time through the blower filter 94. After exiting the blower filter 94, the air is exhausted to the atmosphere.

The invention has been found to provide a canister vacuum cleaner with all the conveniences of prior art canister vacuum cleaners, but with increased dust removal efficiency and without excessive mechanical complexity and resulting expense of manufacture.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A canister vacuum cleaner comprising:

(a) a chassis having a housing unit, the housing unit having an air inlet and roller means for moving the chassis;

(b) an air blower disposed within the housing unit;

(c) a dust extraction and collection unit disposed within the housing unit, the dust extraction and collection unit comprising:

(i) an enclosed inlet chamber, the inlet chamber being substantially cylindrical in shape with an internal diameter between about 130 mm and about 200 mm, the inlet chamber comprising a bottom wall, at least one generally vertical sidewall, an upper section, and a lower section, the sidewall having an interior height between about 200 mm and about 250 mm, the upper section of the inlet chamber having an air inlet opening through the sidewall; and (ii) an enclosed outlet chamber disposed concentrically within the upper section of the inlet chamber, the outlet chamber having a bottom wall, a top wall and at least one generally vertical sidewall, the bottom wall of the outlet chamber being disposed spaced apart from the bottom wall of the inlet chamber, the top wall having a top wall opening, the sidewall having an interior height between about 50 mm and about 100 mm, the sidewall also having between about 1000 and about 1500 inlet apertures, each inlet aperture defining an area between about 3 $mm^2$ and about 30 $mm^2$, the inlet apertures being disposed in a band around the sidewall of the outlet chamber, the band having a width between about 20 mm and about 50 mm and a median line disposed between about 30 mm and about 100 mm above the bottom wall, the outlet chamber further having an upper section, a lower section and a circular exterior perimeter edge member disposed around the sidewall in the lower section of the outlet chamber, the exterior edge member having a diameter between about 10 mm and about 60 mm less than the internal diameter of the inlet chamber; and (d) duct work for serially connecting in fluid communication the air inlet in the housing unit, the inlet chamber, the outlet chamber and the air blower.

2. The canister vacuum cleaner of claim 1 wherein a cylindrical filter is disposed vertically and concentrically within the outlet chamber.

3. The canister vacuum cleaner of claim 1 wherein a planar filter is disposed across the top wall opening of the outlet chamber.

4. The canister vacuum cleaner of claim 1 wherein a filter is operatively disposed upstream of the air blower.

5. The canister vacuum cleaner of claim 1 wherein a blower filter is operatively disposed downstream of the air blower.

6. The canister vacuum cleaner of claim 5 wherein the blower filter is a HEPA filter.

7. The canister vacuum cleaner of claim 1 wherein the inlet chamber is reversibly installable within the chassis with a press-fit connection.

8. A canister vacuum cleaner comprising:

(a) a chassis having a housing unit, the housing unit having an air inlet and wheels for moving the chassis;

(b) an air blower disposed within the housing unit;

(c) a dust extraction and collection unit disposed within the housing unit, the dust extraction and collection unit comprising:

(i) an enclosed inlet chamber, the inlet chamber being substantially cylindrical in shape with an internal diameter between about 130 mm and about 200 mm, the inlet chamber comprising a bottom wall, at least one generally vertical sidewall, an upper section, and a lower section, the sidewall having an interior height between about 200 mm and about 250 mm, the upper section of the inlet chamber having an air inlet opening through the sidewall; and (ii) an enclosed outlet chamber disposed concentrically within the upper section of the inlet chamber, the outlet chamber having a bottom wall, a top wall and at least one generally vertical sidewall, the bottom wall of the outlet chamber being disposed spaced apart from the bottom wall of the inlet chamber, the top wall having a top wall opening, the sidewall having an interior height between about 50 mm and about 100 mm, the sidewall also having between about 1000 and about 1500 inlet apertures, each inlet aperture defining an area between about 3 $mm^2$ and about 30 $mm^2$, the inlet apertures being disposed in a band around the sidewall of the outlet chamber, the band having a width between about 20 mm and about 50 mm and a median line disposed between about 30 mm and about 100 mm above the bottom wall, the outlet chamber further having an upper section, a lower section and a circular exterior perimeter edge member disposed around the sidewall in the lower section of the outlet chamber, the exterior edge member having a diameter between about 10 mm and about 60 mm less than the internal diameter of the inlet chamber;

(d) a cylindrical filter disposed vertically and concentrically within the outlet chamber;

(e) a planar filter disposed across the top wall opening of the outlet chamber; and (f) duct work for serially connecting in fluid communication the air inlet in the housing unit, the inlet chamber, the outlet chamber and the air blower.

9. The canister vacuum cleaner of claim 8 wherein a filter is operatively disposed upstream of the air blower.

10. The canister vacuum cleaner of claim 8 wherein a blower filter is operatively disposed downstream of the air blower.

11. The canister vacuum cleaner of claim 10 wherein the blower filter is a HEPA filter.

* * * * *